US005913657A

United States Patent [19]

Mollenhauer

[11] Patent Number: 5,913,657

[45] Date of Patent: Jun. 22, 1999

[54] SIDE CHANNEL PUMP

[76] Inventor: Henning Mollenhauer, Hörsten 18, 24594 Remmels, Germany

[21] Appl. No.: 08/875,807

[22] PCT Filed: Jan. 12, 1996

[86] PCT No.: PCT/EP96/00128

§ 371 Date: Nov. 14, 1997

§ 102(e) Date: Nov. 14, 1997

[87] PCT Pub. No.: WO96/24771

PCT Pub. Date: Aug. 15, 1996

[30] Foreign Application Priority Data

Feb. 6, 1995 [DE] Germany ..... 295 01 872 U

[51] Int. Cl.[6] ..... F04D 5/00

[52] U.S. Cl. ..... 415/55.4; 415/55.1

[58] Field of Search ..... 415/55.1, 55.2, 415/55.3, 55.4, 55.5, 55.6, 55.7, 224, 225, 226

[56] References Cited

U.S. PATENT DOCUMENTS

| | | | |
|---|---|---|---|
| 3,558,236 | 1/1971 | Bylsma | 415/55.1 |
| 4,508,492 | 4/1985 | Kusakawa et al. . | |
| 5,011,369 | 4/1991 | Mine et al. . | |

FOREIGN PATENT DOCUMENTS

| | | |
|---|---|---|
| 2 237 073 | 2/1975 | France . |
| 739 353 | 9/1943 | Germany . |
| 38 44 158 | 12/1988 | Germany . |

OTHER PUBLICATIONS

European Patent Office, Patent Abstracts of Japan, vol: 13, No: 455; Publication No. JP1177492, Jul. 1989; Patent No. A 1177492, Jul. 1989.

European Patent Office, Patent Abstracts of Japan, vol: 13, No: 405; Publication No. JP1147196, Jun. 1989; Patent No. A 1147196; Jun. 1989.

European Patent Office; Patent Abstracts of Japan; vol. 13, No: 405; Publicatino No. JP1147195, Jun. 1989; Patent No. A 1147195, Jun. 1989.

*Primary Examiner*—Christopher Verdier

*Attorney, Agent, or Firm*—Alix, Yale & Ristas, LLP

[57] ABSTRACT

A side channel pump has an impeller and a housing which closely encloses the impeller on both sides in the axial direction and about its circumference. Fluid inflow and discharge ports are provided on a first side of the impeller. The side channel is arranged at the second side of the impeller and directly communicates with the inflow port through the impeller. The downstream end of the side channel is connected to the discharge port by a rerouting channel that bypasses the impeller.

12 Claims, 1 Drawing Sheet

Fig. 1
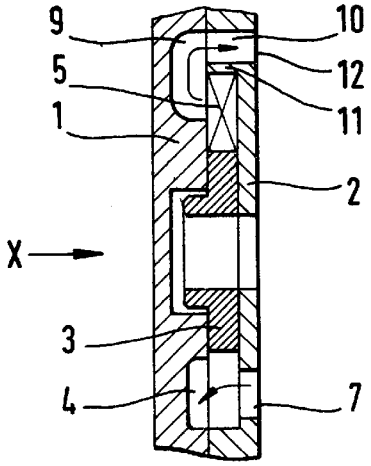
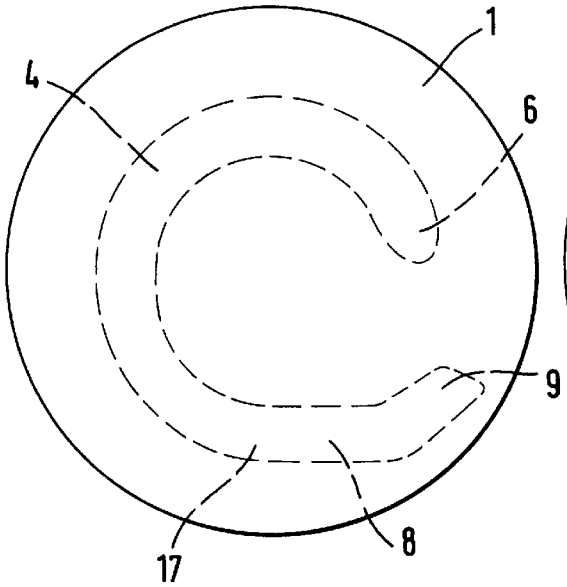
Fig. 3
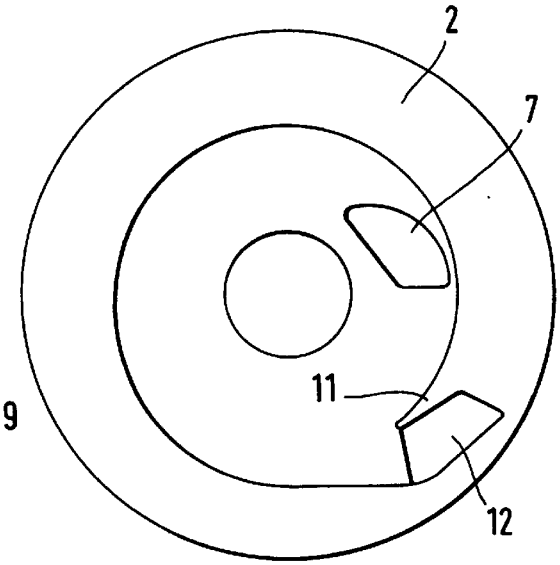
Fig. 2

SIDE CHANNEL PUMP

CROSS-REFERENCE TO RELATED APPLICATIONS

This is the national stage of International Application No. PCT/EP96/00128 filed Jan. 12, 1996.

BACKGROUND OF THE INVENTION

FIELD OF THE INVENTION

The present invention relates to improvements in and to pumps and, particularly, to side channel pumps characterized by increased efficiency and reduced noise generation. Accordingly, the general objects of the present invention are to provide novel and improved apparatus of such character.

In a conventional prior art side channel pump, an impeller with vanes arranged in a star-shaped manner and with open vane interspaces is closely surrounded by a housing. The housing forms axially, next to the impeller, a side channel which is open towards the impeller and in which the medium to be pumped is conveyed by an exchange of pulses with the impeller. German Patent 739,353 shows a prior art side channel pump design which has gained acceptance for single-stage pumps. In this prior pump both the supply and discharge of the medium take place the same side of the impeller. The supply and discharge spaces are consequently concentrated on one part of the pump. In the known pumps of this type, the side channel is also arranged on that side of the impeller on which the medium is supplied and discharged. This arrangement makes it simpler to guide the medium being pumped, because the inflow and outflow ports are connected directly to the side channel.

In other pump types, in which the supply and discharge of the medium take place on different sides of the impeller, and particularly in the case of multi-stage pumps, the medium being pumped has to flow from the supply side through the impeller to the discharge side (Pohlenz: Pumpen für Flüssigkeiten und Gase, Berlin 1975, page 336, 337).

There has been a long standing desire in the art to improve the efficiency and suction capacity of side channel pumps while simultaneously reducing the noise generated during the operation of such pumps

SUMMARY OF THE INVENTION

The present invention overcomes the above briefly-discussed and other deficiencies and disadvantages of the prior art by providing a novel and improved side channel pump wherein, on each impeller stage, the side channel is arranged on the opposite side of the impeller with respect to the supply and discharge ports. In a pump in accordance with the invention, the outflow end of the side channel is connected to the pump discharge port by means of a channel which extends radially to the outside of the impeller.

A pump in accordance with the present invention has a somewhat more complicated construction when compared to the prior art due to the fact that the side channel is not arranged on the medium supply and discharge side of the impeller. Nevertheless, cavitation in the liquid inflow region has been found to be reduced. This effect is unexpected. In previously proposed side channel pumps, unlike the pump of the present invention, a buffer cross-section of the side channel is provided between the medium inflow port and the impeller to minimize cavitation whereas, in accordance with the present invention, the medium coming from the medium inflow port strikes the impeller directly.

The discharge structure of a side channel pump in accordance with the invention is also novel and contrary to conventional practice. As is known from multi-stage pumps, there is per se no problem in guiding the medium being pressurized through the impeller from the side channel to the outflow port. It would therefore have been obvious to guide the medium from the side channel through the impeller to the outflow port. A requisite characteristic of side channel pumps is that they require a comparatively small amount of space and material, this characteristic being achievable because the housing closely surrounds the impeller on the circumference and its diameter is therefore restricted essentially to approximately the impeller diameter. The rerouting channel of a side channel pump in accordance with the invention is located radially outwardly with respect to the circumference of the impeller and this entails an enlargement of the pump housing. However, this departure from conventional design practice is outweighed by the advantages of the invention.

The special rerouting channel is expediently separated completely form the housing space, in which the impeller rotates, in the region of the plane of the impeller.

Since the medium being pumped does not pass through the impeller immediately upstream of the outflow port, i.e., the vanes of the impeller do not directly pass over the outflow port and thereby transmit sound pulses into the same, pumps in accordance with the invention generate considerably less noise when compared to the prior art.

In the case of peripheral pumps, it is known to arrange an outflow channel radially outside the impeller. On this point, reference may be made to U.S. Pat. No. 4,508,492, JP-A-1177492 Abstract, JP-A-1147196 Abstract, JP-A-1147195 Abstract, FR-A-2,237,073 and DE-A-3,844,158. Nevertheless, fundamentally different design preconditions prevail in the case of peripheral, i.e., vortex vacuum, pumps from those in the case of side channel pumps. In particular, where peripheral pumps are concerned, the channel through which the medium being pumped is conveyed, which has an exchange of pulses with the impeller, is arranged in such a way that it surrounds the impeller symmetrically on both sides and on the circumference. This necessarily results in the medium being discharged radially and, if appropriate, tangentially for the purpose of reducing the losses. Nevertheless, it is well known that peripheral pumps generate a greater amount of noise than do conventional side channel pumps. Accordingly, experience gained with peripheral pumps would not suggest that the discharge of the medium to the region located radially outside the impeller could be associated with noise reduction.

BRIEF DESCRIPTION OF THE DRAWINGS

The invention is explained in more detail below with reference to the drawing which illustrates diagrammatically an advantageous exemplary embodiment. In the drawings;

FIG. 1 shows an axial suction through the impeller and the two part housing part enclosing it, FIG. 2 shows a view, taken in the direction X of FIG. 1, of the housing part containing the inflow and outflow ports, and FIG. 3 shows a view of the other housing part in the same viewing direction.

DESCRIPTION OF THE DISCLOSED EMBODIMENT

The housing parts 1 and 2 define a chamber or space in which the impeller 3 rotates on a shaft which is not illustrated. The impeller 3 has a plane of rotation, oriented transversely relative to its axis of rotation, which is located intermediate the opposite sides of the impeller. The side channel 4 is formed in the housing part 1 and is open towards the vanes 5 of the impeller 3. The inflow end 6 of channel 4 is located, relative to the impeller space, opposite the inflow port 7 formed in the housing part 2. Accordingly, the medium entering through inflow port 7 will pass through the interspaces between the vanes 5 when flowing to the side channel 4. The inflow port 7 is connected to suction spaces, through which the medium passes, located upstream of inflow port 7. These suction spaces, which cooperate with the inflow port 7 to define devices for supplying the medium, may be arranged in the same correspondingly widened housing part 2 or in a preceding housing part which is not illustrated.

The downstream end 17 of the side channel 4 is led tangentially outwards in the region 8, so that a rerouting channel is produced. Portion 9 of the rerouting channel is disposed in the housing part 1 and located axially on one side of the impeller 3. The rerouting channel then passes, in portion 10 thereof, into a region located radially outside the diameter of the impeller 3. Radially outside the impeller, the rerouting channel has an axial direction component leading to the other side of the impeller. The end of the rerouting channel 10 which is located in the housing part 2 forms the outflow port 12 of the pump. The medium, when being transferred from portion 9 of the rerouting channel into portion 10 thereof, is deflected in the axial direction. The rerouting channel is separated from the impeller space by a housing tongue 11, so that the impeller does not exert any further influence on the medium stream in this region of the medium flow path. The outflow stream will thereby be calmed and less noise is generated. The medium passes out of the outflow port 12 in the known way into a pump delivery space, not illustrated. The outflow port 12 thus in part defines the device for discharging the medium from the pump. The delivery space may also be formed in the housing part 2 and, in such case, part 2 would be designed to be correspondingly larger than shown in the drawing. Alternatively, a further special housing part, not shown in the drawing, which contains the delivery space and the suction space may be connected to the disc-shaped housing part 2.

If the housing tongue 11 is omitted, so that the rerouting channel portions 9 and 10 remain open towards the impeller, a power-increasing exchange of pulses between the medium and the impeller can take place in this region. Such a modified construction may have advantages, even though the noise reduction is not as great as in the example illustrated.

The rerouting channel may be designed as a diffuser. There is generally no need for the channel 9, 10 to be deflected in the axis-parallel direction. Instead, the channel portion 10 is expediently oriented obliquely in the circumferential and axial directions. For these reasons, the outflow port 12 in the housing part 2 is expediently given a considerably larger cross-section (measured parallel to the impeller plane) than the side channel (measured in the longitudinal plane). As a rule, the cross-section of the outflow port will be larger than the cross-section of the side channel upstream of the rerouting channel by the factor 1.5 to 3.

I claim:

1. A side channel pump comprising:

an impeller, said impeller having first and second oppositely disposed sides and an axis of rotation, a plane of rotation of said impeller being oriented transversely with respect to said axis and being located intermediate said sides, said impeller further having plural vanes which extend between said sides and cooperate to define the circumference of said impeller; and a pump housing, said housing defining a chamber in which said impeller rotates, said housing further defining spatially displaced medium inflow and outflow ports located on said first side of said impeller, said medium inflow port being in direct fluid communication with said chamber, said housing further defining a side channel located on said second side of said impeller, said side channel having first and second ends and being open to said chamber whereby said first end of said side channel is in fluid communication with said inflow port through said impeller, said housing additionally defining a rerouting channel for conveying a fluid medium between said second end of said side channel and said outflow port, said rerouting channel extending across said impeller plane in a region located radially outside the circumference of said impeller.

2. The side channel pump of claim 1 wherein said rerouting channel is separated from said chamber in the region where said rerouting channel extends across said impeller plane by a portion of said housing which in part defines said chamber.

3. The side channel pump of claim 2 wherein said side channel has an arcuate shape and wherein a portion of said rerouting channel extends tangentially from said second end of said side channel.

4. The side channel pump of claim 3 wherein the cross-sectional size of said outflow port is at least 1.5 times larger than the cross-sectional area of said side channel.

5. The side channel pump of claim 4 wherein said tangentially extending portion of said rerouting channel merges with a downstream rerouting channel portion which is located radially outside the circumference of said impeller, said downstream rerouting channel portion extending across said impeller plane, said downstream rerouting channel portion imparting a component of motion which is in a direction parallel to said axis of rotation to the fluid medium being pumped.

6. The side channel pump of claim 3 wherein said tangentially extending portion of said rerouting channel merges with a downstream rerouting channel portion which is located radially outside the circumference of said impeller, said downstream rerouting channel portion extending across said impeller plane, said downstream rerouting channel portion imparting a component of motion which is in a direction parallel to said axis of rotation to the fluid medium being pumped.

7. The side channel pump of claim 2 wherein the cross-sectional size of said outflow port is at least 1.5 times larger than the cross-sectional area of said side channel.

8. The side channel pump of claim 1 wherein said side channel defines an arcuate flow path between said ends thereof and wherein a portion of said rerouting channel extends tangentially from said second end of said side channel.

9. The side channel pump of claim 8 wherein the cross-sectional size of said outflow port is at least 1.5 times larger than the cross-sectional area of said side channel.

10. The side channel pump of claim 9 wherein said tangentially extending portion of said rerouting channel merges with a downstream rerouting channel portion which is located radially outside the circumference of said impeller, said downstream rerouting channel portion extending across said impeller plane, said downstream rerouting channel portion imparting a component of motion which is in a direction parallel to said axis of rotation to the fluid medium being pumped.

11. The side channel pump of claim 8 wherein said tangentially extending portion of said rerouting channel merges with a downstream rerouting channel portion which is located radially outside the circumference of said impeller, said downstream rerouting channel portion extending across said impeller plane, said downstream rerouting channel portion imparting a component of motion which is in a direction parallel to said axis of rotation to the fluid medium being pumped.

12. The side channel pump of claim 1 wherein the cross-sectional size of said outflow port is at least 1.5 times larger than the cross-sectional area of said side channel.

* * * * *